US007878115B2

(12) United States Patent
Yamashita et al.

(10) Patent No.: US 7,878,115 B2
(45) Date of Patent: Feb. 1, 2011

(54) LINE-PATTERN FORMATION METHOD AND LINE-PATTERN FORMATION APPARATUS

(75) Inventors: Ayano Yamashita, Tokyo (JP); Naoki Ozawa, Tokyo (JP); Hiroyuki Urabe, Kawasaki (JP); Emiko Nakasato, Kawasaki (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 841 days.

(21) Appl. No.: 11/889,433

(22) Filed: Aug. 13, 2007

(65) Prior Publication Data

US 2008/0041247 A1 Feb. 21, 2008

(30) Foreign Application Priority Data

Aug. 18, 2006 (JP) ..... 2006-223678

(51) Int. Cl.
*B26F 1/32* (2006.01)
*B26F 1/14* (2006.01)
*B44C 1/24* (2006.01)

(52) U.S. Cl. ..... 101/30; 101/19; 101/327; 33/645

(58) Field of Classification Search ..... 101/28, 101/29, 30, 19, 406, 327, 333, 405; 33/533, 33/645, 562, 613; *B26F 1/32, 1/14; B41K 3/04; B44C 1/24*

See application file for complete search history.

(56) References Cited

U.S. PATENT DOCUMENTS 4,509,397 A * 4/1985 Mori et al. ..... 83/453
2003/0037657 A1 2/2003 Oh et al.
2005/0241508 A1 * 11/2005 Winston ..... 101/327

FOREIGN PATENT DOCUMENTS

JP U 3102990 5/2004

* cited by examiner

*Primary Examiner*—Judy Nguyen
*Assistant Examiner*—Jennifer Simmons
(74) *Attorney, Agent, or Firm*—Oliff & Berridge, PLC

(57) ABSTRACT

A line-pattern formation apparatus includes: a pattern former with a display defining a pattern and a referential projection indicating a reference position of the pattern; a positioning plate including a line-pattern indicator indicating a plurality of patterns in a lateral condition and a reference-positioning indicator specifying the reference position of the patterns; and a positioner including a stand on which a sheet is placed and a fixing member for fixing the sheet placed on the stand. The fixing member is provided with fitting portions for making the positioning plate detachably attached to the fixing member.

7 Claims, 9 Drawing Sheets

HAPPY BIRTHDAY

LINE-PATTERN FORMATION METHOD AND LINE-PATTERN FORMATION APPARATUS

BACKGROUND OF THE INVENTION

1. Field of the Invention

The present invention relates to a method and an apparatus for forming a line-pattern on a sheet such as paper or cloth, particularly to the method and the apparatus operable to adjust a position of the line-pattern in a condition that the interval of each pattern of the line-pattern is optimally adjusted.

2. Description of the Related Art

Conventionally, in formation of ornamental cards, etc., in which various patterns are arranged in a horizontal direction, a pattern former such as a die-cutting punch, stamp, etc has been applied. For example, in US patent application publication No. 2003/0037657 (hereinafter referred to as "Reference 1"), a die-cutting punch is combined with a plate provided with markers to be positioned so as to form die-cutting patterns in sequence.

Further, in Utility Model Registration No. 3102990 (hereinafter referred to as "Reference 2"), the following is disclosed: a narrow rectangular plate is attached to the bottom end of a handle portion so as to form a stamp body; holes are provided at regular intervals at the bottom surface of the narrow rectangular plate; and engaging projections provided at the back surface of a printing portion are fitted into the holes so as to form a desired stamp for a character string.

In the reference 1, however, only identical patterns are formed in a sequent manner. The reference 1 cannot arrange various patterns at optimal intervals. Further, in the reference 2, the holes provided at the narrow rectangular plate of the stamp body are arranged at regular intervals. Therefore, when a line-pattern of a character string such as "HAPPY BIRTHDAY" is formed, as shown in FIG. 13, relatively large space needs to be occupied each side of "I" relative to the adjacent character, resulting in ill-balance between each character.

On the other hand, if the character is stamped one by one at desired intervals, it makes possible to adjust the interval of each character. However, in order to stamp each character at an exact position in consideration of the interval relative to the adjacent character, considerable skills would be needed. There thus might be some occasions that the characters (patterns) are not arranged in an intended manner. Especially, in a pattern former such as a die-cutting punch with a complicated structure, the user cannot perform a pressure operation while observing the cutter of the pattern former. It thus causes the user great difficulties to even form one pattern at a desired position on a sheet. If a plurality of patterns are needed to be arranged in a horizontal direction at desired intervals, it is not difficult to imagine that the user experiences further strenuous situation.

As discussed above, for achieving an optimal arrangement in the line-pattern or character string, a high-level skill to position the patterns or characters would be required. Especially, considering a birthday card, etc. required for a good quality design, the formation thereof is further difficult.

SUMMARY OF THE INVENTION

The present invention has been made in the light of the above problems, and it is an object of the present invention to provide a line-pattern formation method and a line-pattern formation apparatus wherein the interval of each pattern can be optimally adjusted.

In order to achieve the object described above, according to a first aspect of the present invention, there is provided a formation method of a line-pattern comprising: a pattern former including a display defining a pattern and a referential projection indicating a reference position of the pattern, the pattern former forms given patterns on a sheet by a pressure operation; a positioning plate including a line-pattern indicator indicating a plurality of patterns in a lateral condition and a reference-positioning indicator specifying the reference position with respect to each pattern of the line-pattern; and a positioner including a stand on which the sheet is placed and a fixing member for fixing the sheet placed on the stand, wherein the positioning plate is placed at the fixing member, the referential projection of the pattern former is positioned so as to correspond to the reference-positioning indicator on the positioning plate, which matches a pattern indicated on the pattern former, and the pressure operation of the pattern former is performed.

With the formation method described above, a sheet is placed on a stand; the sheet is fixed with a fixing member; a positioning plate including a line-pattern indicator and a reference-positioning indicator is fixed to the fixing member; and in the condition patterns are formed on the sheet with a pattern former. Since the user can perform positioning according to the line-pattern indicator and the reference-positioning indicator on the positioning plate, the user can form each line-pattern at optimal intervals. More specifically, the pattern former has only one pattern corresponding to the single pattern of the line-pattern indicator formed on the positioning plate. The reference position of the pattern former is then positioned to be correspondent to the reference-positioning indicator of the positioning plate. In the condition the pattern former is operated. Since the operation is repeatedly performed for each pattern of the line-pattern indicator, the user can easily form the pattern identical with the line-pattern indicated on the positioning plate.

In the first aspect of the present invention, the formation method may further comprises a pattern sample including a pattern indication in various shapes and a pattern-positioning indicator for setting the reference position of each pattern indication, wherein a given pattern indication is selected from the pattern sample, and then the pattern indication and the pattern-positioning indicator are copied on a transparent plate so as to fabricate the positioning plate.

With the formation method described above, a desired pattern is selected from the pattern sample (first-selected pattern), and then the transparent plate is placed on the selected pattern so that the pattern indication and the pattern-positioning indicator are copied on the transparent plate. The pattern desired to be placed adjacent to the formerly selected pattern is then chosen (second-selected pattern). By setting as desired the interval between the first-selected pattern and the second-selected pattern, the second-selected pattern and the pattern-positioning indicator corresponding thereto are also copied.

In addition to the above, it is possible to first select a plurality of desired patterns from the pattern sample and copy the patterns on the transparent plate at the desired intervals. Then, while superimposing each of the selected patterns on the transparent plate onto the pattern of the pattern sample, the pattern-positioning indicator of the pattern sample may be copied on the transparent plate. Note that the meaning of "copy" hereinabove used is not limited to only a handwritten manner, but also affixing patterns on the transparent plate or coping patterns electrically or mechanically on the transparent plate may be included.

By repeatedly performing the above process in a sequential manner, the user can form the desired positioning plate on which the line-pattern is indicated. The line-pattern formed by the user can be then applied to a sheet such as Christmas cards, etc.

According to a second aspect of the present invention, there is provided a line-pattern formation apparatus comprising: a pattern former including a display defining a pattern and a referential projection indicating a reference position of the pattern, the pattern former forms given patterns on a sheet by a pressure operation; a positioning plate including a line-pattern indicator indicating a plurality of patterns in a lateral condition and a reference-positioning indicator specifying the reference position with respect to each pattern of the line-pattern; and a positioner including a stand on which the sheet is placed and a fixing member for fixing the sheet placed on the stand, wherein the fixing member is provided with a fitting portion for making the positioning plate detachably attached to the fixing member.

With the line-pattern formation apparatus described above, the fixing member is provided with the fitting portion so that the positioning plate can be detachably attached to the fixing member. The user can thus prepare in advance the various kinds of positioning plates with the various types of line-patterns and can replace one by one the desired positioning plates from the fitting portion of the fixing member, being able to form the plural numbers of desired line-patterns in an easy manner.

According to a third aspect of the present invention, there is provided with a line-pattern formation apparatus comprising: a pattern former including a display defining a pattern and a referential projection indicating a reference position of the pattern, the pattern former forms given patterns on a sheet; a pattern sample including a pattern indication in various shapes and a pattern-positioning indicator for setting the reference position of each pattern indication; a transparent plate enabling to see-through the pattern indication and the pattern-positioning indicator of the pattern sample; and a positioner including a stand on which the sheet is placed and a fixing member for fixing the sheet placed on the stand, wherein the fixing member is provided with a fitting portion for making the transparent plate detachably attached to the fixing member.

With the line-pattern formation apparatus described above, the fixing member is provided with the fitting portion so that the transparent plate can be detachably attached to the fixing member. By mounting a self-made positioning plate in the fitting portion of the fixing member, it is possible to form self-made line-patterns on the sheet.

In the second and third aspects of the present invention, the fixing member may be attachable to the stand in a rotatable manner. Since the fixing member is rotatably attached to the stand, it is possible to fabricate the stand and the fixing member in an integral manner. Further, the user may abut the end portion of the sheet against the rotational axis of the stand so as to being able to position the sheet.

In the second and third aspects of the present invention, the stand and the fixing member are fabricated in such a manner as to bend a plane member. Since the positioner including the stand and the fixing member can be made by bending the plane member so as to rotatably attach to the stand, the positioner can be made in a relatively easy manner. In this case, the plane member means the one with a prescribed area, and the meaning of the plane includes the surface having a convexoconcave area or opening necessary to achieve the function as the positioner.

In the second and third aspects of the present invention, the pattern former further comprises: a perforation cutter directed downward to the open portion of the housing; an operation cover in which to vertically move the perforation cutter; a base including a guide passage for guiding the perforation cutter and a slit orthogonally provided relative to the guide passage; a housing provided with the operation cover so as to cover the upper-opened portion of the housing, in which the housing houses the base provided with the perforation cutter, wherein the perforation cutter is movable toward the open portion of the housing with a sliding motion along the guide passage so as to form given patterns on the sheet, and the stand of the positioner is provided with a cutout portion so as to make end portions of the sheet revealed in a condition that the sheet is fixed with the fixing member.

With the line-pattern formation apparatus described above, even in the pattern former wherein die-cutting patterns are formed on the sheet by inserting the sheet into the slit, like a punch, the user can easily position the sheet, enabling to form the line-pattern at the optimum intervals.

In the second and third aspects of the present invention, the stand and the fixing member may be fabricated into an approximately U-shape by bending a plane member with a prescribed open area. Since the positioner including the stand and the fixing member are fabricated into an approximately U-shape by bending the plane member with the prescribed open area, the positioner can be manufactured in an easy manner and at low cost.

In the second and third aspects of the present invention, the cutout portion of the stand of the positioner may be rotatably provided with a paper adjuster for adjusting the end position of the sheet. With this structure, the user can correctly set the position from the end position of the sheet to the pattern to be formed (distance 1). In this case, the paper adjuster may be provided with a ruler standing relative to the major surface of the paper adjuster, so that the end portion of the sheet can be abutted to the ruler, enabling to set the distance 1. Further, the paper adjuster may be provided with a scale for setting the distance 1.

BRIEF DESCRIPTION OF THE DRAWINGS

FIG. 11 is an explanatory view showing a forming method of a positioning plate in FIG. 10 by using the pattern sample and the transparent plate, in which

DETAILED DESCRIPTION OF THE PREFERRED EMBODIMENTS

Preferred embodiments of the present invention will be described with reference to the accompanying drawings. The present invention is however not limited to those embodiments hereinafter described but applicable with another embodiments as long as the proposed problems hereinbefore described can be solved.

Embodiment 1

Figure 1:
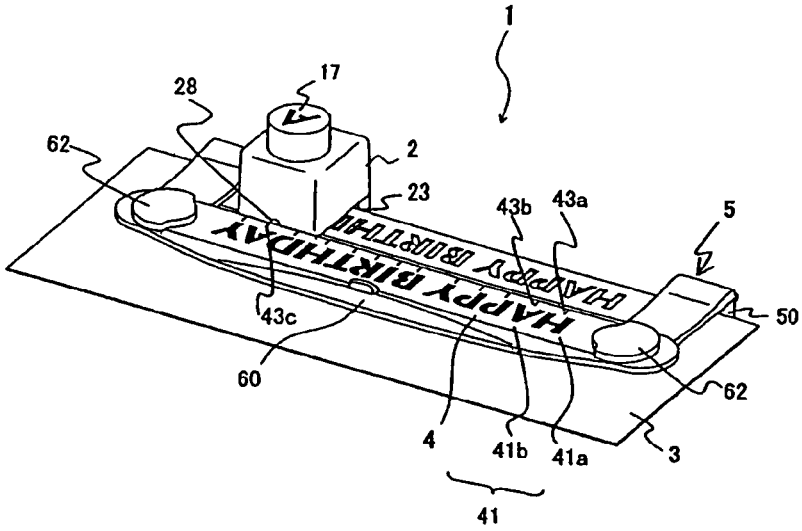
FIG. 1 is an explanatory view of a line-pattern formation method according to a first embodiment of the present invention.

FIG. 1 shows an explanatory view of a line-pattern formation method according to a first embodiment of the present invention. This line-pattern formation method is the one to form a die-cutting pattern such as a character string on a sheet, for example, paper, cloth or synthetic resin. For a practical base, a line-pattern formation apparatus 1 according to the embodiments of the present invention is applied. To begin with, the line-pattern formation apparatus 1 will be described hereinbelow.

The line-pattern formation apparatus 1 comprises: a punch 2 as a pattern former; a positioning plate 4 on which a pattern formed on a sheet 3 is displayed; and a positioner adjusting the position of the punch 2 with the positioning plate 4.

Figure 2:
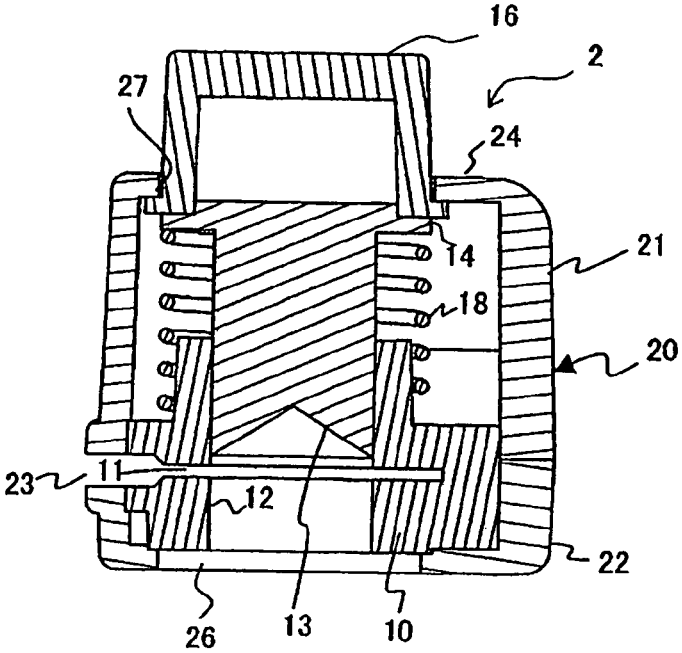
FIG. 2 is a longitudinal section view of a pattern former in FIG. 1.

The punch 2 functions as a pattern former in which to form a given pattern on the sheet 3. As shown in FIG. 2, the punch 2 comprises a base 10, a perforation cutter 13, a housing 20 for housing the assembled body of the base 10 and the perforation cutter 13.

The housing 20 is made of a synthetic resin material suitably selected, the external shape of which is cuboidal, and the inner shape of which is formed analogous to the external shape. The housing 20 comprises an upper housing 21 and a lower housing 22 so that the housing 20 can be separated into two separate portions. At the connection of the upper housing 21 and the lower housing 22, a slit 23 hereinafter described in detail is provided at the position where correspondent to the location of the slit 11 of the base 10.

Further, the circumference of the top opening of the upper housing 21 is provided with a guiding wall 27 for guiding the outer circumference surface of an operation cover 16 for a perforation cutter 13. The bottom surface of the lower housing 22 is also provided with an open portion 26 so that the cut-off of the sheet is fallen off through the open portion 26.

Still further, a referential projection 28 is provided at the center bottom portion of the lower hosing 22. See FIG. 1 in detail. This referential projection 28 works for identifying the reference position of the pattern formed by the punch 2. The base 10 is made of the material such as zinc metal, etc. and is provided with the slit 11 parallel to the open portion of the lower housing, so that the sheet can be inserted into the slit 11. At the lower hosing 22, a guide passage 12 is provided perpendicular relative to the slit 11, so that the perforation cutter 13 can be slidably guided. The cross section of the guide passage 12 is identically configured with the one of the perforation cutter 13, so that the perforation cutter 13 can be guided while sliding on the inner wall surface of the guide passage 12.

The perforation cutter 13 is made of the identical material with the base 10, the cross section of which is configured into: graphics such as circle, triangle or square, star; characters such as numbers, symbols or alphabet; or patterns such as animals or flowers. The perforation cutter 13 is pressed in a direction orthogonal relative to the sheet such as paper, synthetic resin, fiber, metal, leather, etc. The bottom end of the perforation cutter 13 (cutting edge) thus contacts with the corner at which the slit 11 and the guide passage 12 intersect, so that the sheet inserted into the slit 11 can be perforated.

Furthermore, at the top end of the perforation cutter 13, a flange 14 is provided. See FIG. 2. While inserting the perforation cutter 13 into the guide passage 12 of the base 10, a spring 18 is provided between the bottom surface of the flange 14 and the upper surface of the base 10. In the above condition that the spring 18 is assembled, the spring 18 is designed to be slightly compressed. When the perforation cutter 13 is pressed downward, the spring 18 is approximately made a full compression. Still further, the operation cover 16 is mounted on the flange 14 of the perforation cutter 13. On the top face of the operation cover 16, a display 17 is provided, so that a pattern formed by the punch 2 (for example, "A" in FIG. 1) can be identified.

Next, the configuration method of the punch 2 by assembling the base 10, the perforation cutter 13 and the housing 20 will be explained. First, the spring 18 is provided between the bottom surface of the flange 14 of the perforation cutter 13 and the top surface of the base 10, and the perforation cutter 13 is then inserted into the guide passage 12 of the base 10 so as to assemble the base 10 and the perforation cutter 13.

Next, the assembly of the base 10 and the perforation cutter 13 is mounted on the lower housing 22 in the position that the slit 11 of the base 10 is made correspondent to the cutout of the lower housing 22 (portion forming a slit 23). While the perforation cutter 13 is mounted with the operation cover 16, the guiding wall 27 is made gone along the lateral face of the operation cover 16. In the condition, the upper housing 21 is mounted to the lower housing 22.

Figure 3:
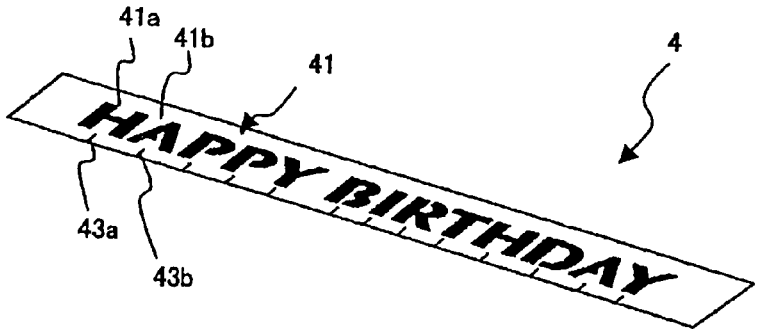
FIG. 3 is a perspective view of a positioning plate in FIG. 1.

By assembling the punch in the method hereinabove described, the assembly including the base 10 and the perforation cutter 13 can be housed within the housing 2. Next, the positioning plate 4 will be explained with reference to FIG. 3. The positioning plate 4 is made of a prescribed side of sheet or plate, on which the line-pattern indicator 41 and the reference-positioning indicators 43*a*, 43*b*, etc. are indicated.

The line-pattern indicator 41 is the one that a plurality of patterns 41*a*, 41*b*, etc. are arranged in a horizontal direction. The line-pattern indicator 41 according to the embodiment of the present invention is a character string making "HAPPY BIRTHDAY" in which each character in the character string, for example, "H" or "A" is formed with a respective pattern former (punch). Adjacent to the character, there is provided a reference-positioning indicator identifying the center position (reference position) of each character. See FIG. 1.

The positioner 5 will be explained with reference to FIG. 4. The positioner 5 comprises: a stand 50 on which the sheet is placed; a fixing member 60 fixing the sheet placed on the stand 50; and a paper adjuster 70 by which the end of the sheet is adjusted.

Figure 5:
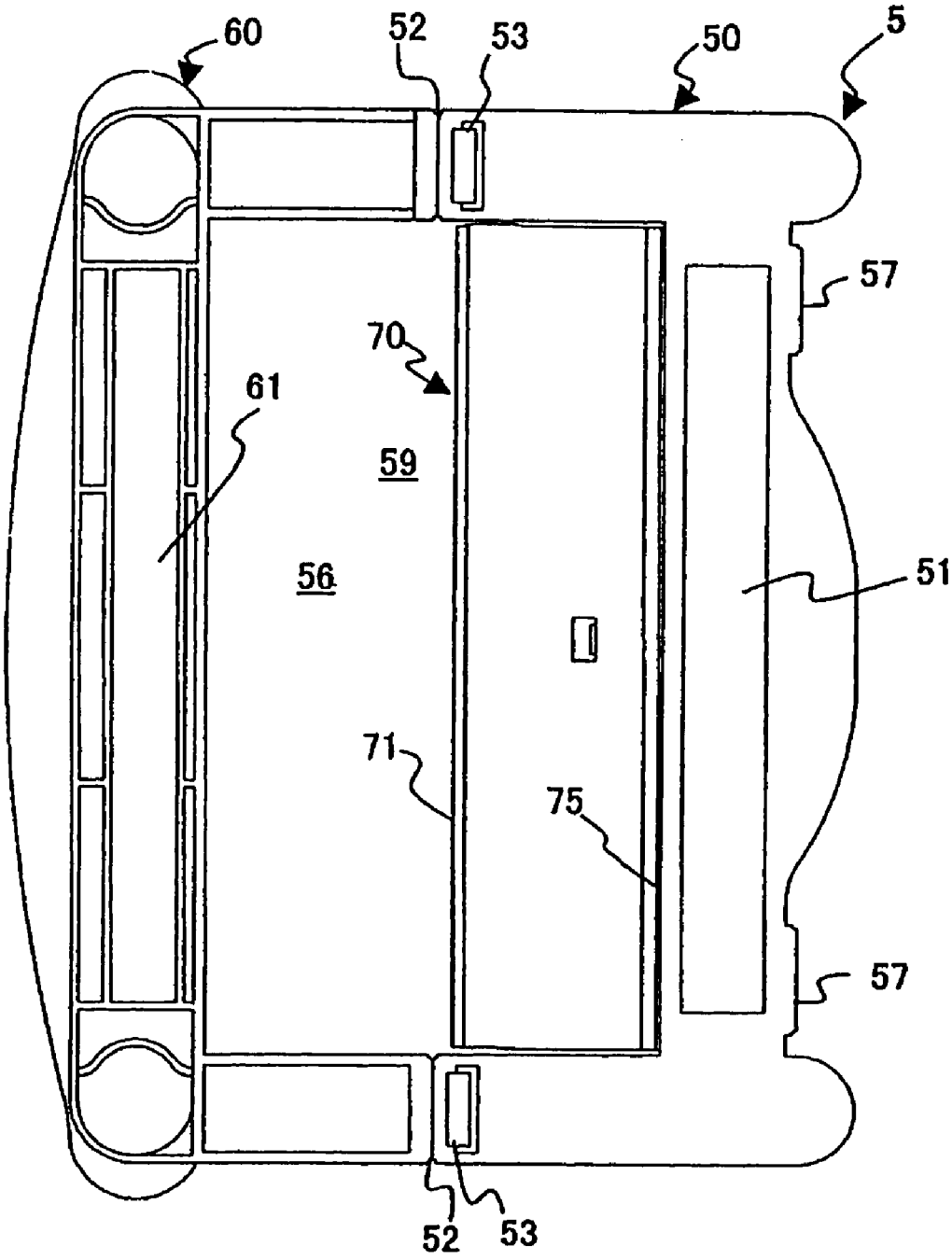
FIG. 5 is a front view of the fixing member of the positioner in FIG. 1 in a condition that the fixing member is rotated in a 180-degree arc.

The stand 50 is the one on which the sheet formed with the line-pattern is placed and is formed into a U-shaped plane body where the intermediate portion of one side thereof is cut out. This cutout 59 aims at making the end of the sheet revealed when the sheet is fixed between the stand 50 and the fixing member 60. The revealed end of the sheet is then inserted into the slit 23 of the punch 2, and the punch 2 is pressed so as to form die-cutting patterns on the sheet. See FIG. 1. As shown in FIG. 5, adsorptions 51, 61 (steel plate or magnet) are provided at the back face of the fixing member 60 (also meaning at the top surface of the stand 50). Further, abutting portions 53, 53 are provided adjacent to connecting portions 52, 52, so that the end of the sheet placed on the stand 50 can be adjusted.

Figure 6:
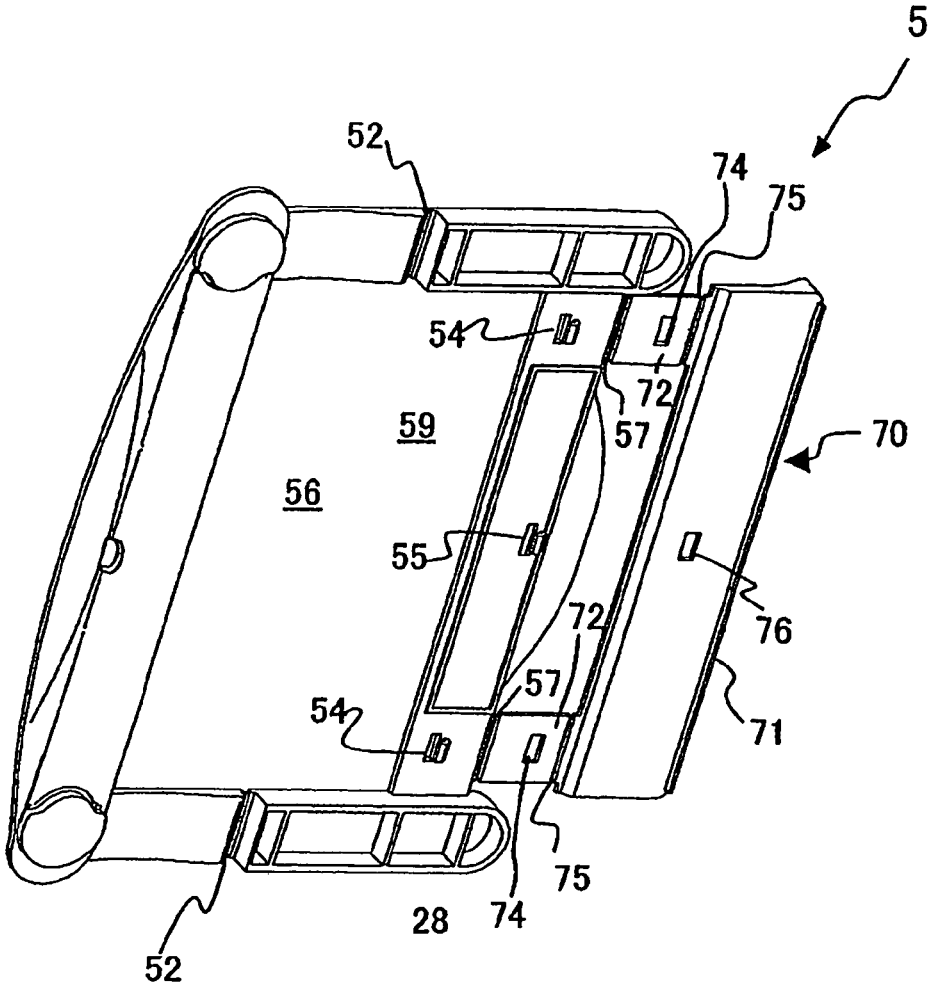
FIG. 6 is an expansion perspective view of the paper adjuster of the positioner in FIG. 1 in a condition that the paper adjuster is rotated and seen from the bottom side thereof.

At the undersurface of the stand 50, as shown in FIG. 6, the first engaging stoppers 54, 54 and the second engaging stopper 55 are provided. The first engaging stoppers 54, 54 are for fixing the paper adjuster 70 onto the stand 50 and are formed at the position where correspondent to the first engaging recesses 74, 74 provided on connections 72, 72 of the paper adjuster 70. The second engaging stopper 55 is for fixing the paper adjuster 70 onto the stand 50 when the paper adjuster 70 fixed to the stand 50 is rotated to the underside of the stand 50. The engaging stopper 55 is formed at the position where correspondent to an engaging projection provided on the paper adjuster 70 (hereinafter described in detail).

At the connecting portions 52, 52 of the stand 50, the fixing member 60 is rotatably provided. In this case, the stand 50 and the fixing member 60 can be fabricated by bending a plane member with a prescribed open area 56. Here, by bending the plane member at approximately center of the open portion 56 (that is, the portion where the connecting portions 52 and 52 are connected), the fixing member 60 can be fabricated in such a manner as to be a U-shape and bilateral symmetry relative to the stand 50. At the back face of the fixing member 60, as shown in FIG. 5, the adsorption 61 (magnet or iron plate) is attached, so that, by making the adsorption 61 to attach and fix to the adsorption 51 on the stand 50, the sheet held between the stand 50 and the fixing member 60 can be fixed.

Figure 4:
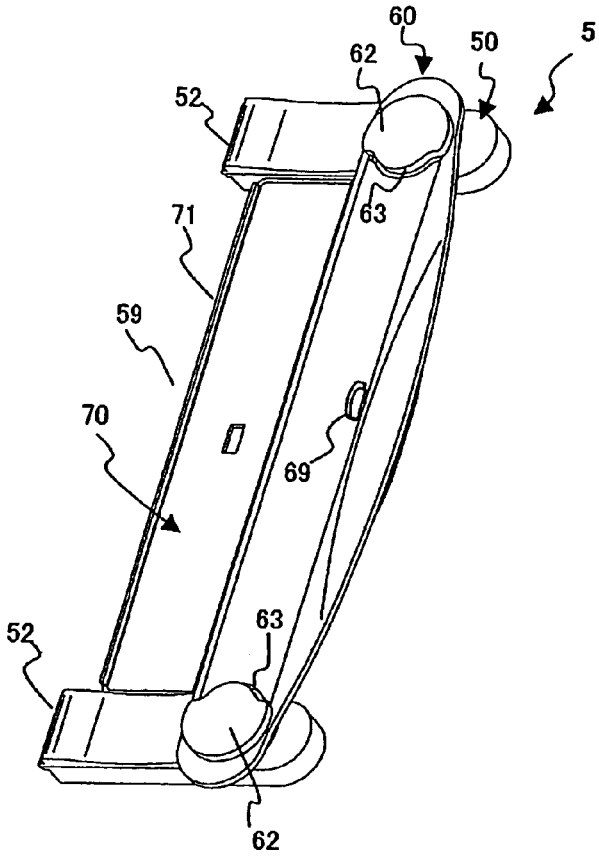
FIG. 4 is a perspective view of a positioner in FIG. 1.

On the upper surface of the fixing member 60, as shown in FIG. 4, fitting portions 62, 62 for detachably mounting the positioning plate 4 are provided at both lateral ends of the positioning plate 4. Each of the fitting portions has a recess or opening 63 at its side where facing each other, so that the both lateral ends of the positioning plate 4 can be introduced thereinto. Those fitting portions 62, 62 are designed to achieve a proper form in consideration of the size of the positioning plate 4 or the depth of the slit 23 in the punch 2, etc. Also, on the upper surface of the fixing member 60, a stopper 69 is provided for setting the side of the positioning plate 4.

At the cutout portion 59 of the stand 50, the paper adjuster 70 is provided in a rotatable manner. This paper adjuster 70 is for positioning the edge face of the sheet, and is thus provided with a paper fixing portion 71 in a upward direction relative to the main surface of the paper adjuster 70. The paper fixing portion 71 is placed at the end portion of the paper adjuster 70, opposite to the side that the stand 50 is mounted. The paper fixing portion 71 is advantageous in case the size of sheet is small so that the bilateral ends of sheet cannot abut to the abutting portions of the stand 50. In these cases, by abutting the edge face of sheet to the paper fixing portion 71, sheet in relatively smaller size can be properly positioned.

In the above case, the stand 50, the fixing member 60 and the paper adjuster 70 are, as shown in FIG. 6, fabricated by a single plane sheet material. That is, the paper adjuster 70 is provided at another side of the stand 50 via the connections 72, 72. The connections 72, 72 are provided with the engaging recesses 74,74 engageable with the first engaging stoppers 54, 54 on the stand 50. With this structure, the paper adjuster 70 are rotated into a downward direction in FIG. 6 around first folded lines 57, 57 on the stand 50 so as to engage the first engaging stoppers 54, 54 with the engaging recesses 74, 74. Through the above process, as shown in FIG. 5, it will achieve the structure that the paper adjuster 70 is rotatably mounted on the cutout portion 59 of the stand 50. In this case, by adjusting the length of the connections 72, 72 to be equal to the width of the stand 50 (that is, the width between the first folded lines 57, 57 and the cutout portion 59), it is possible to achieve the structure that the paper adjuster 70 is rotatable toward the undersurface of the stand 50 (toward the reverse side of the FIG. 5) around second folded lines 75, 75 provided between the connections 72, 72 and the paper adjuster 70. The single plane sheet material discussed above may be made of soft synthetic resin such as polypropylene resin and be formed in an integral manner via an injection molding. On the back side of the paper adjuster 70 (that is, the side opposite to the side where the paper fixing portion is provided), the engaging projection 76, which is engageable with the second engaging stopper 55 of the stand 50, is provided. By rotating the paper adjuster 70 toward the undersurface of the stand 50 so as to engage the engaging projection 76 with the second engaging stopper 55, the paper adjuster 70 can be fixed to the undersurface of the stand 50. Next, the formation of line-patterns by using the line-pattern formation apparatus will be discussed.

First, the positioning plate 4 is mounted to the fitting portions 62, 62 of the positioner 5 in the condition of FIG. 4. Next, as shown in FIG. 1, following the placement of the sheet 3 on the stand 50, the fixing member 60 is rotated downward so as to fix the sheet 3 placed between the stand 50 and the fixing member 60. Then, the paper adjuster 70 is made to escape toward the undersurface of the stand 50 so as to reveal the end surface of the sheet 3.

The punch 2 is introduced into the end surface of the sheet 3 revealed. Here, when introduced, the referential projection 28 of the punch 2 is made to correspond in position to the reference-positioning indicator 43*c* of the positioning plate 4. By pressing the punch 2, die-cutting patterns can be made on the sheet 3. Repetitive pressing of the punch 2 with respect to all patterns 41*a*, 41*b* . . . of the line-pattern indicator 41 on the positioning plate 4 will form line-patterns on the sheet 3.

In the embodiment of the present invention, the pattern indication of the pattern former (for example "A" in FIG. 1) is not necessarily indicated on the display 17 of the operation cover 16 of the pattern former 2 but may be indicated on some place on the housing 20. Further, the referential projection 28 is not necessarily placed at the center of each character but may be, for example, placed to indicate either lateral edge of the character. Also, the referential projection 28 is not limited to projected formations but may be fabricated into any other form as long as completing its functional purpose.

In the embodiment of the present invention, the punch 2 is applied for a pattern former. However, any other device may be applied as long as predetermined patterns can be formed on a sheet by pressing operation. As one of the examples of the pattern former in another embodiment, a stamp may be the one to be selected, for the stamp can strike predetermined patterns on a sheet by making a striking surface descendant onto the sheet with pressing operation of an operation portion. In this case, for example, by inserting a spring between a flange provided at the bottom of the housing and a flange provided at a stamping tool, the stamping tool is energized upward. If an ink-filled container is installed in the stamping tool so that ink oozes out from the container to the stamping tool, an inking stand will no longer necessary, facilitating its service condition.

Figure 7:
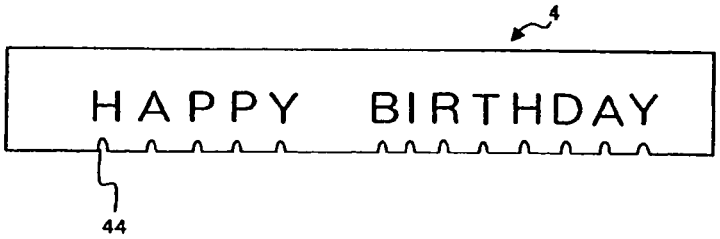
FIG. 7 is a front view of the positioning plate in FIG. 1 in another example.
Figure 8:
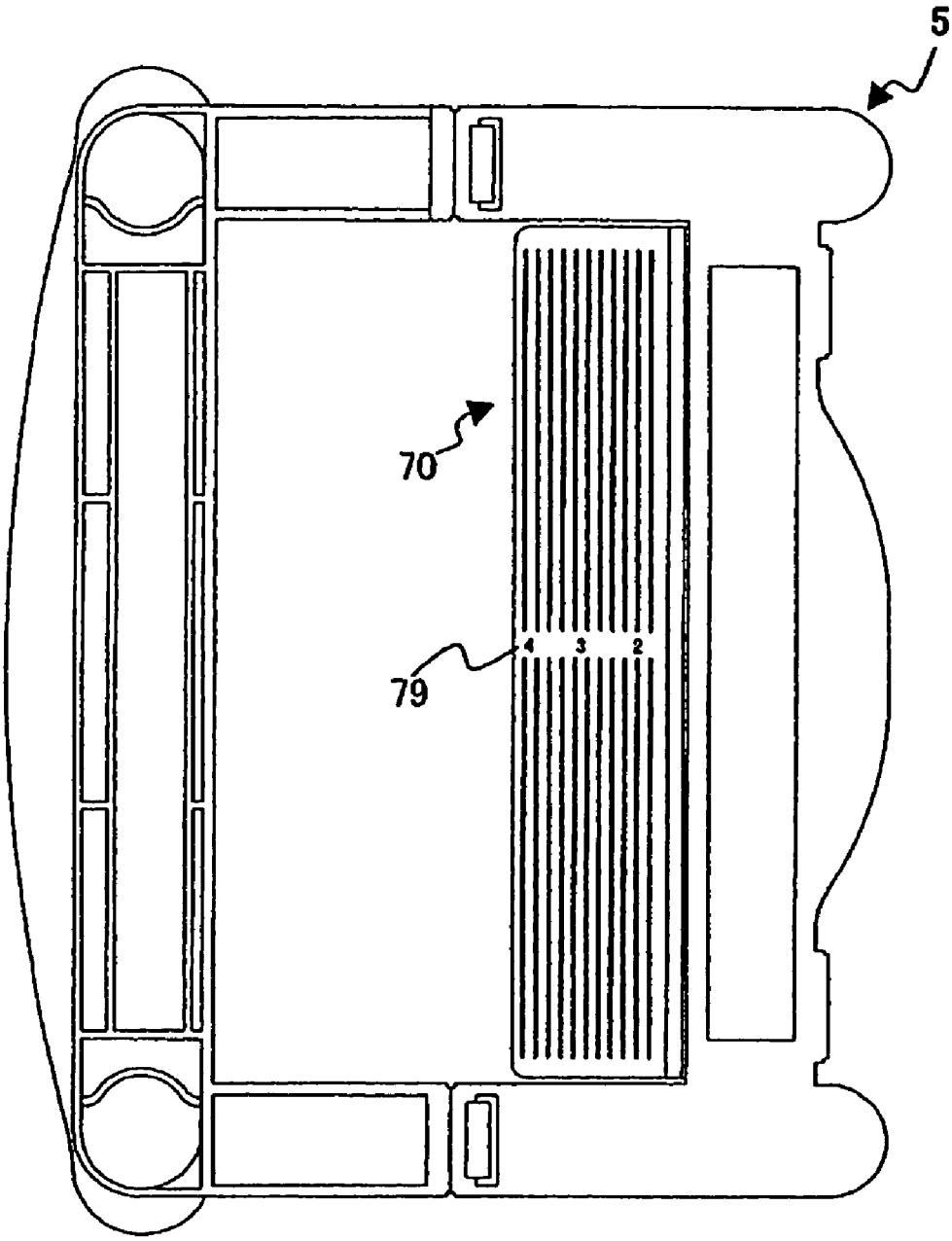
FIG. 8 is a front view of the paper adjuster of the positioner in FIG. 1 in another example.

Still further, the reference-positioning indicator 43*a*, 43*b*, etc. on the positioning plate 4 may be, as shown in FIG. 7, reentrants 44 engageable with the referential projections 28 of the punch 2. As to the paper adjuster 70 of the positioner 5, it may be connected to the cutout portion 59 of the stand 50. Or, The paper adjuster itself may be eliminated from the line-pattern formation apparatus. It is also possible to place a scale on the paper adjuster 80. See FIG. 8. With this structure, it makes possible to form given patterns in any desired position from the edge line of the sheet.

In addition, the fitting portion 62 of the fixing member 60 of the positioner 5 may be a magnetic material, an adhesive material, etc. as long as the positioning plate 4 is locked or fixed. The positioner 5 may be fabricated not integrally formed by a single plane member but may be fabricated by separate parts. The positioner 5 may be also fabricated as that the fixing member 60 is not rotatable relative to the stand 50. In this case, the stand 50 and the fixing member 60 may be fabricated as separate parts; the stand 50 and the fixing member 60 may attach to each other by a magnet, etc.

Second Embodiment

Figure 9:
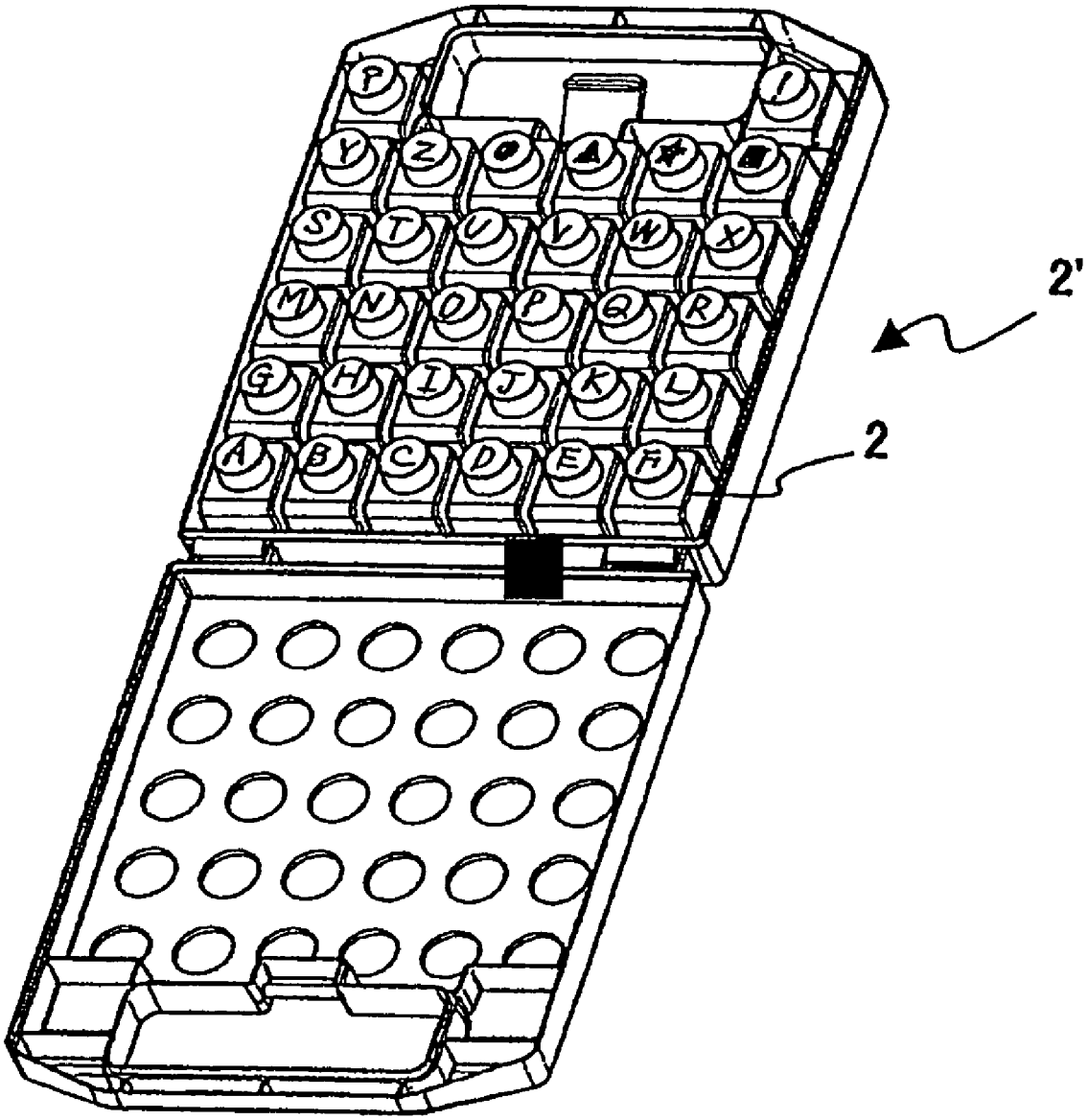
FIG. 9 is a perspective view of a punch set used in a line-pattern formation method according to a second embodiment of the present invention.

Next, the line-pattern formation method according to the second embodiment of the present invention will be described hereinbelow. This line-pattern formation method is, as shown in FIG. 9, quite serviceable when fabricating work of high creativity. This work can be achieved by the punch 2 of a set of punches 2', the pattern sample 8 as well as the transparent plate 9 (see FIG. 10), and the positioner 5 (see FIG. 4).

Figure 10:
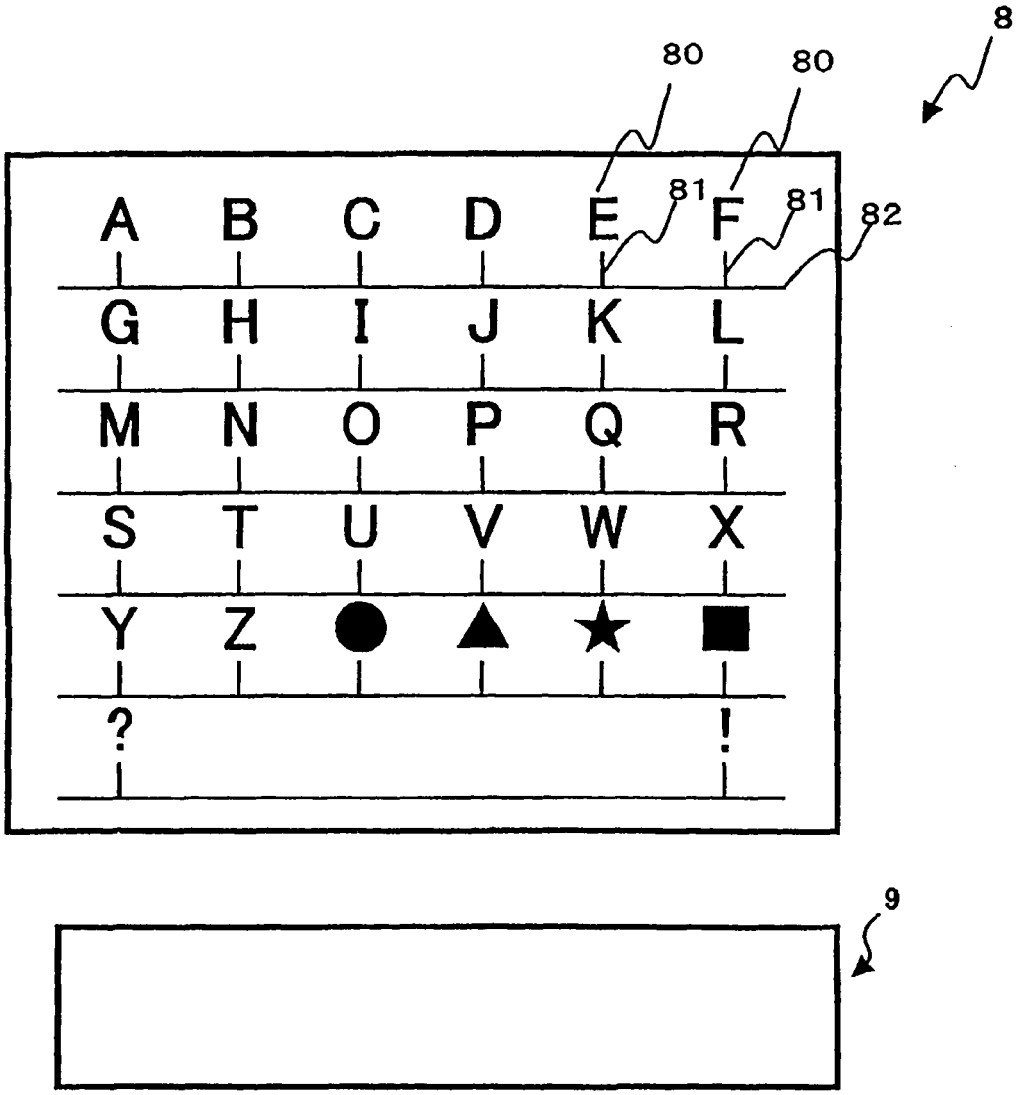
FIG. 10 is a front view of a pattern sample and a transparent plate used in the line-pattern formation method of FIG. 9.

The structure of the punch 2 and the positioner 5 is identical with the one described in the first embodiment, thus the detail explanation thereof will be omitted. The pattern sample 8 as shown in FIG. 10 shows all pattern indications 80 of the punch 2 in the set of punches 2', and the pattern-positioning indicators 81. The pattern indications 80 of the pattern sample 8 are indicated as identical in sizes with the patterns formed by the punch 2. The pattern-positioning indicator 81 is provided at each of the pattern indications 80 (just below the indications 80), which show a central position of each of the pattern indications 80 in a lateral direction on the pattern sample 8 (see FIG. 10 in detail). Further, aligning lines 82 are provided in a lateral direction in FIG. 10 in which to meet one end of the pattern-positioning indicators 81, so that the edge of the transparent plate 9 can be adjusted in its position.

The transparent plate 9 has size enabling to install to the pairs of fitting portions 62, 62 of the positioner 5. The transparent plate 9 also is a sheet or plate, which has transparency that can see through the pattern indications 80 and the pattern-positioning indicators 81 when placed on the pattern sample 8. Hereinbelow, the formation method of the line-pattern by using the line-pattern formation apparatus described above will be explained.

Figure 11A:
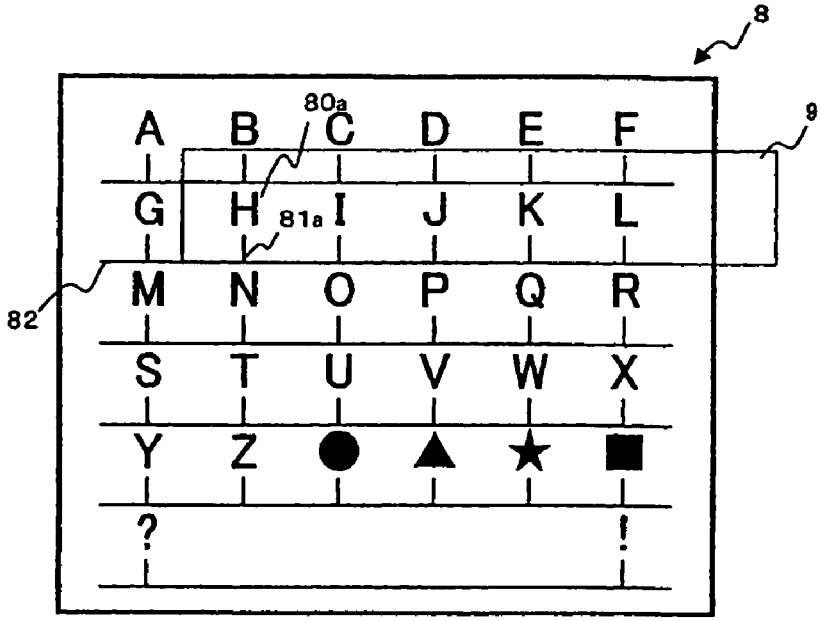
FIG. 11A shows the condition that a desired pattern and a pattern-positioning indicator are copied on the transparent plate.

First, as shown in FIG. 11A, the transparent plate 9 is placed onto a pattern 80*a* desired on the pattern sample 8. Here, the bottom edge of the transparent plate 9 is set to the aligning line 82. Then, the pattern 80*a* and a reference line 81*a* correspondent to the pattern 80*a* are copied on the transparent plate 9.

Figure 11B:
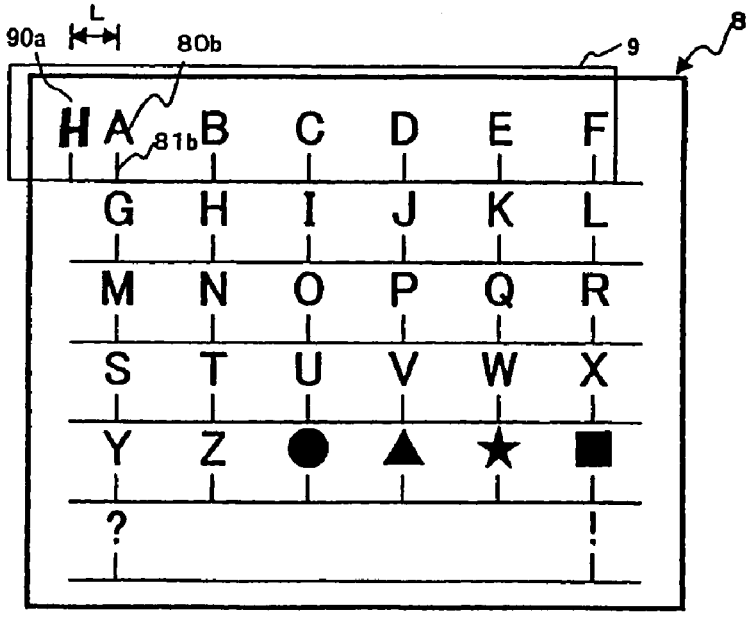
FIG. 11B shows the condition that an adjacent pattern and the pattern-positioning indicator are copied on the transparent plate.
Figures 12, 13:
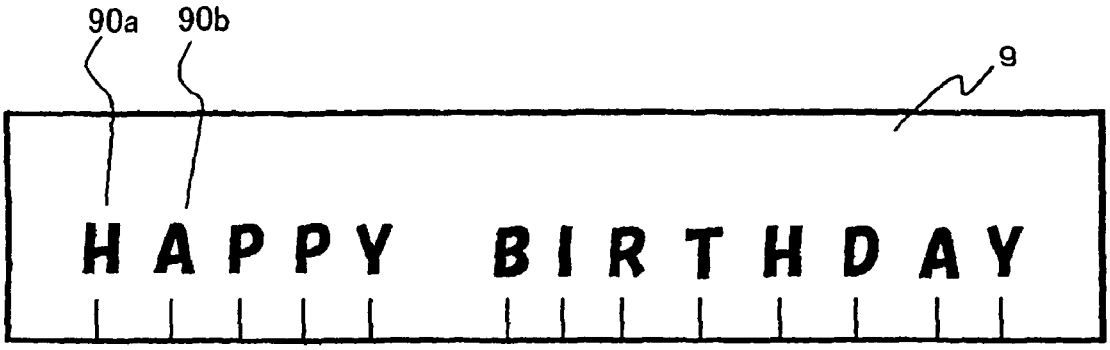
FIG. 13 (Prior Art)
FIG. 12 is a front view of the positioning plate fabricated by the pattern sample and the transparent plate in FIG. 10.
FIG. 13 is an explanatory view of a line-pattern fabricated by a conventional line-pattern formation method.

As shown in FIG. 11B, following the above process, a pattern 80*b* desired to arrange next to the pattern 80*a* is selected. After setting a desired interval L in which to determine the space between a copied pattern 90*a* copied on the transparent plate 9 and the pattern 80*b*, the pattern 80*b* and a reference line 81*b* correspondent to the pattern 80*b* are copied on the transparent plate 9. By repeating the above process, as shown in FIG. 12, each pattern (for example, 90*a*) can be arranged on the transparent plate with a space desired relative to the adjacent pattern (for example, 90*b*).

As a result, by using the pattern sample 8 and the transparent plate 9, the user can fabricate the positioning plate 4 on which the line-pattern indicator 41 and the reference-positioning indicator 43*a*, 43*b*, etc. are printed. By fixing the positioning plate 4 (that is, transparent plate 9) to the fitting portions 62, 62 of the fixing member 60 of the positioner 5, the line-pattern formation method according to the first embodiment as shown in FIG. 1 can be attained.

Here, it is also possible that when the line-pattern indicator 41 and the reference-positioning indicator 43*a*, 43*b*, etc. are copied on the transparent 9, desired copied patterns (for example, 90*a*, 90*b* in FIG. 12) are arranged on the transparent plate 9 in advance. While the copied patterns are then superimposed on the patterns (for example, 80*a*, 80*b* in FIG. 11) of the pattern sample 8, the reference lines 81*a*, 81*b*, etc. of the pattern sample 8 may be copied on the transparent plate 9. The arrangement of the pattern in this case may be by a freehand manner onto the transparent plate 9, or may be that the patterns cut out into an identical shape are affixed onto the transparent plate 9. In this method, the user can place the line-patterns made by himself on a sheet.

What is claimed is:

1. A line-pattern formation apparatus comprising:

a pattern former including a display defining a pattern and a referential projection indicating a reference position of the pattern, the pattern former forms given patterns on a sheet by a pressure operation;

a positioning plate including a line-pattern indicator indicating a plurality of patterns in a lateral condition and a reference-positioning indicator specifying the reference position with respect to each pattern of the line-pattern; and a positioner including a stand on which the sheet is placed and a fixing member for fixing the sheet placed on the stand, wherein the fixing member is provided with a fitting portion for making the positioning plate detachably attached to the fixing member.

2. The line-pattern formation apparatus according to claim 1, wherein the fixing member is attached to the stand in a rotatable manner.

3. The line-pattern formation apparatus according to claim 2, wherein the stand and the fixing member are fabricated in such a manner as to bend a plane member.

4. The line-pattern formation apparatus according to claim 1, wherein the pattern former comprises:

a perforation cutter directed downward to an open portion of a housing;

an operation portion in which to vertically move the perforation cutter;

a base including a guide passage for guiding the perforation cutter and a slit orthogonally provided relative to the guide passage;

the housing provided with the operation portion so as to cover an upper-opened portion of the housing, in which the housing houses the base provided with the perforation cutter, wherein the perforation cutter is movable toward the open portion of the housing with a sliding motion along the guide passage so as to form given patterns on the sheet, and the stand of the positioner is provided with a cutout portion so as to make end portions of the sheet revealed in a condition that the sheet is fixed with the fixing member.

5. The line-pattern formation apparatus according to claim 4, wherein the stand and the fixing member are fabricated into an approximately U-shape by bending a plane member having a given open area.

6. The line-pattern formation apparatus according to claim 4, wherein the cutout portion of the stand of the positioner is rotatably provided with a paper adjuster for adjusting the end position of the sheet.

7. A line-pattern formation apparatus comprising:

a pattern former including a display defining a pattern and a referential projection indicating a reference position of the pattern, the pattern former forms given patterns on a sheet;

a pattern sample including a pattern indication in various shapes and a pattern-positioning indicator for setting the reference position of each pattern indication;

a transparent plate enabling to see-through the pattern indication and the pattern-positioning indicator of the pattern sample; and a positioner including a stand on which the sheet is placed and a fixing member for fixing the sheet placed on the stand, wherein the fixing member is provided with a fitting portion for making the transparent plate detachably attached to the fixing member.

* * * * *